US009302284B2

(12) United States Patent
Alluigi

(10) Patent No.: US 9,302,284 B2
(45) Date of Patent: Apr. 5, 2016

(54) TRIGGER DISPENSERS

(71) Applicant: GUALA DISPENSING S.p.A., Alessandria (IT)

(72) Inventor: Riccardo Alluigi, Alessandria (IT)

(73) Assignee: GUALA DISPENSING S.P.A., Spinetta Marengo, Alessandria (IT)

( * ) Notice: Subject to any disclaimer, the term of this patent is extended or adjusted under 35 U.S.C. 154(b) by 0 days.

(21) Appl. No.: 14/411,124

(22) PCT Filed: May 31, 2013

(86) PCT No.: PCT/IB2013/054511

§ 371 (c)(1),
(2) Date: Dec. 24, 2014

(87) PCT Pub. No.: WO2014/013352

PCT Pub. Date: Jan. 23, 2014

(65) Prior Publication Data

US 2015/0151315 A1 Jun. 4, 2015

(30) Foreign Application Priority Data

Jul. 17, 2012 (IT) ..... BS2012A0109

(51) Int. Cl.

| | |
|---|---|
| ***B65D 88/54*** | (2006.01) |
| ***G01F 11/00*** | (2006.01) |
| ***B05B 11/00*** | (2006.01) |

(52) U.S. Cl.

CPC ..... *B05B 11/3011* (2013.01); *B05B 11/3019* (2013.01); *B05B 11/3045* (2013.01); *B05B 11/3064* (2013.01)

(58) Field of Classification Search

USPC ..... 222/321.8, 320, 321.1, 372, 383.1, 384, 222/385

See application file for complete search history.

(56) References Cited

U.S. PATENT DOCUMENTS

| | | | | | |
|---|---|---|---|---|---|
| 5,228,602 | A * | 7/1993 | Maas | B05B 11/3011 | 222/340 |
| 6,095,377 | A * | 8/2000 | Sweeton | B05B 11/0016 | 222/383.1 |
| 6,116,472 | A * | 9/2000 | Wanbaugh | B05B 11/0016 | 222/340 |
| 7,500,582 | B2 * | 3/2009 | Pritchett | B05B 11/0043 | 222/321.7 |
| 2008/0149671 | A1 * | 6/2008 | Sweeton | B05B 11/0064 | 222/383.1 |
| 2011/0174843 | A1 * | 7/2011 | Rech | B05B 11/0059 | 222/376 |
| 2012/0091229 | A1 * | 4/2012 | Laidler | B05B 7/0037 | 239/330 |
| 2014/0239018 | A1 * | 8/2014 | Maas | B05B 11/0008 | 222/383.1 |

FOREIGN PATENT DOCUMENTS

| | | | | |
|---|---|---|---|---|
| EP | 0798050 | A1 | 10/1997 | |
| EP | 1974826 | A1 | 10/2008 | |
| IT | EP 0798050 | A1 * | 10/1997 | B05B 11/3011 |
| JP | H08224509 | A | 9/1996 | |
| JP | H10151384 | A | 6/1998 | |
| JP | H10180158 | A | 7/1998 | |
| WO | 2011143555 | A1 | 11/2011 | |
| WO | 2012069939 | A1 | 5/2012 | |

* cited by examiner

*Primary Examiner* — J. Casimer Jacyna
*Assistant Examiner* — Benjamin R Shaw
(74) *Attorney, Agent, or Firm* — Robert E. Alderson, Jr.

(57) ABSTRACT

Trigger dispensers for liquids which include a dispenser head having a sliding valve dispenser element are provided. Also provided are dispenser heads suitable for use with trigger dispensers for liquids.

16 Claims, 13 Drawing Sheets

TRIGGER DISPENSERS

CROSS-REFERENCE TO RELATED APPLICATIONS

This application is a National Phase Application of PCT International Application No. PCT/IB2013/054511, International Filing Date, May 31, 2013 claiming priority to Italian Patent Application No. BS2012A000109, filed Jul. 17, 2012, each of which is hereby incorporated by reference in its entirety.

FIELD OF THE INVENTION

The object of the present invention is a manual dispenser for a liquid, preferably a trigger dispenser.

BACKGROUND OF THE INVENTION

Trigger dispensers are highly widespread and used in different fields, for example for spraying household detergent liquids, anti-odour liquids, clothing ironing liquids. The production volumes of such devices are very large; a few hundred million pieces a year are currently produced.

It is therefore clear that improving a structural feature of a component of the dispenser or improving a step of the production process have a considerable economic implication.

In the specific field, many efforts in the research and development of new components aim to integrate a plurality of functions in a single component, especially if such component can be moulded.

In particular, trigger dispensers are known in which a single component integrates multiple valve functions, for example as described in the International Patent Application WO 2012/069939 by the Applicant.

However, known devices have some drawbacks, for example related to a poor behaviour repeatability in the dispensing.

SUMMARY OF THE INVENTION

The object of the present invention is to provide a manual liquid dispenser, in particular a trigger dispenser, which should meet the requirements of structural simplicity while overcoming the drawbacks mentioned with reference to the prior art.

Such object is achieved by a manual dispenser as described and claimed herein.

Features and advantages of trigger dispensers and dispenser heads according to the present invention will be evident from the following description, with reference to the annexed Figures.

DETAILED DESCRIPTION

With reference to the annexed figures, a manual dispenser 1 comprises a container C having an inner compartment V for the containment of the liquid to be dispensed, comprising a neck N consisting of an annular wall about a container axis X, which by an annular edge B defines a container opening A to access inside said compartment V.

Dispenser 1 comprises a dispenser head 20 attached to container C for manually drawing the liquid from the container and dispense it to the exterior.

Head 20 is preassembled and is generally sent to the filling of the container separately therefrom. After filling the container with liquid, the head is coupled to the container.

Figure 7:
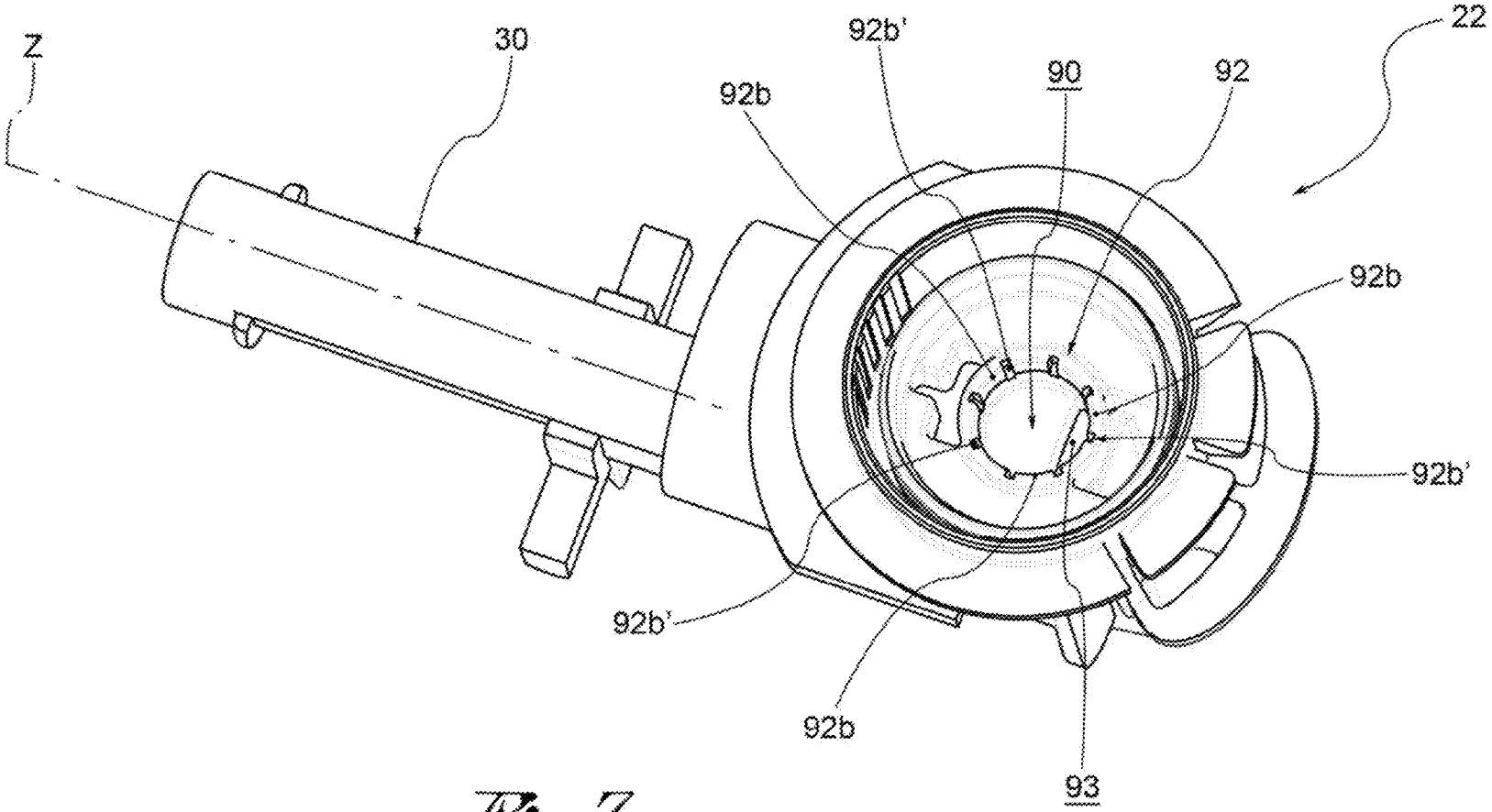
FIG. 7 shows a frame of the head of FIG. 1.
Figure 8:
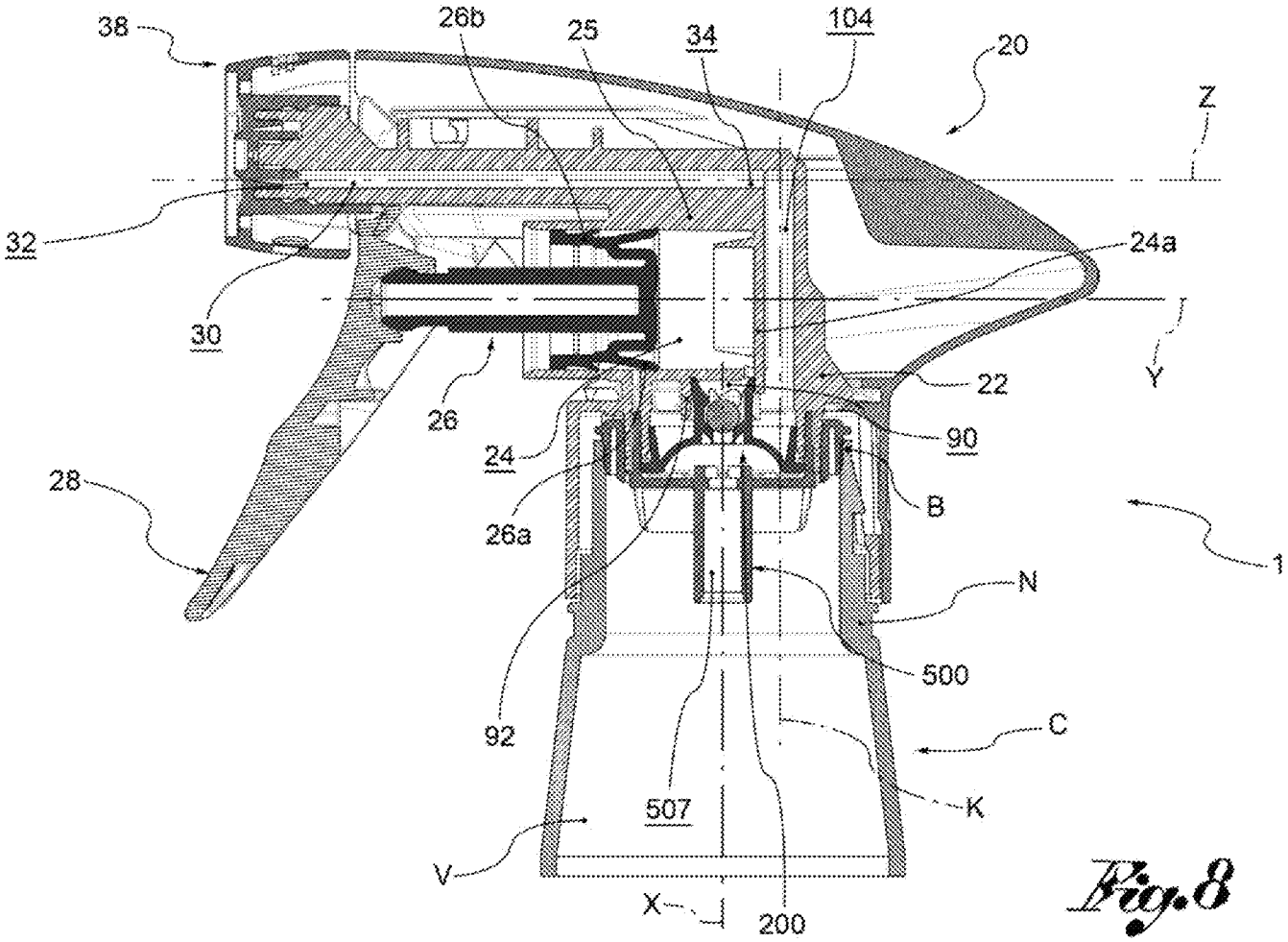
FIG. 8 shows a cross section of a dispenser head of a dispenser according to an even further embodiment of the present invention.
Figure 9:
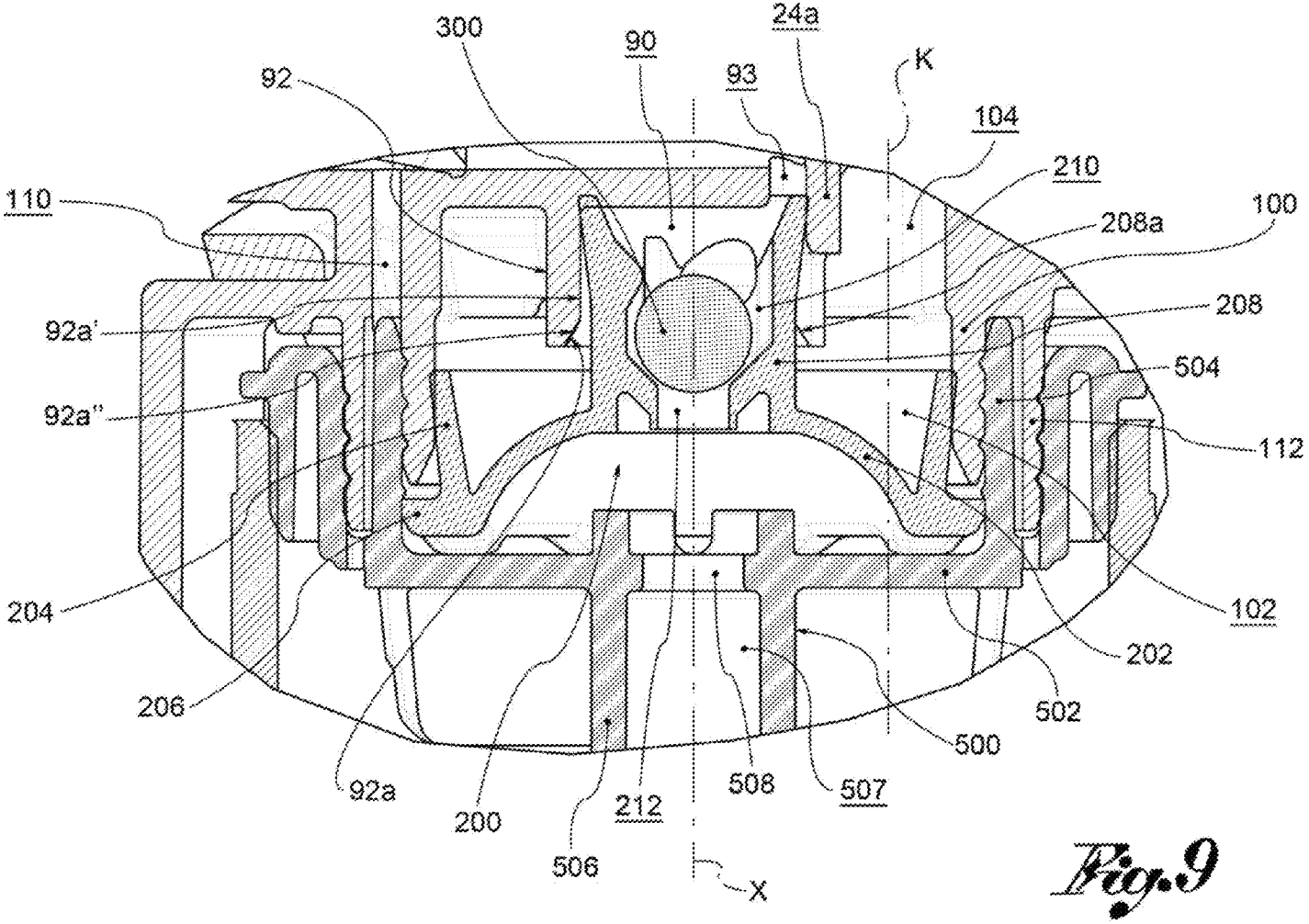
FIG. 9 shows an enlargement of a detail of FIG. 8.
Figure 10A:
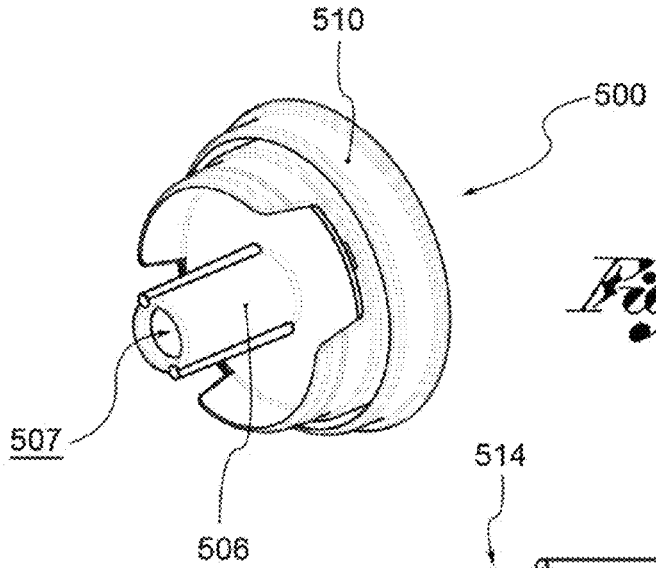
FIG. 10*a* shows an auxiliary body of the connection element of the head of FIG. 8.
Figure 10B:
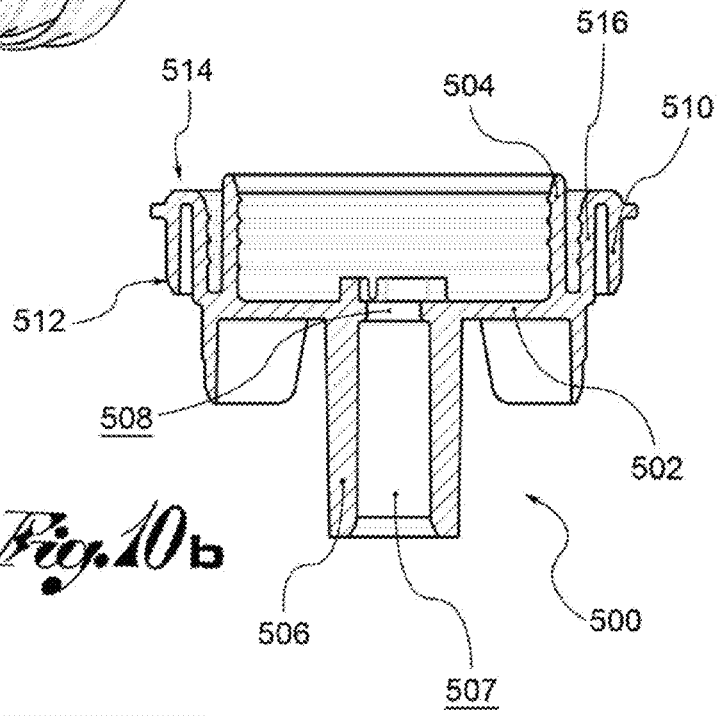
FIG. 10*b* shows a cross section of the auxiliary body of FIG. 10*a;*
Figure 10C:
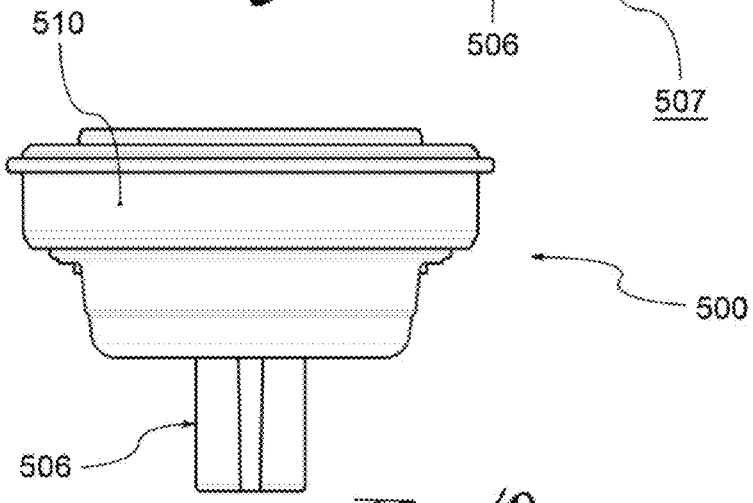
FIG. 10*c* shows a side view of the auxiliary body of FIG. 10*a;*
Figure 11A:
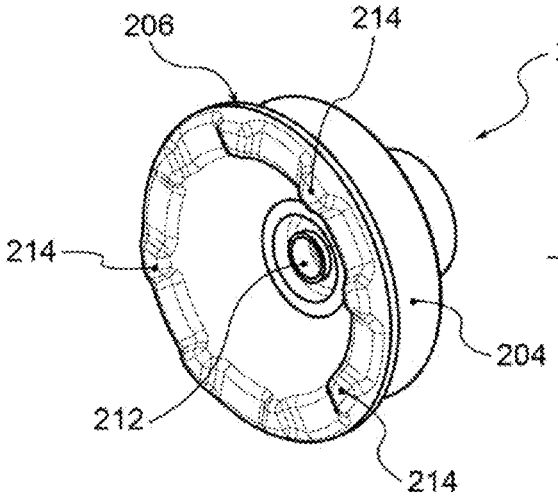
FIG. 11*a* shows a main body of the valve element of the head of FIG. 8.
Figure 11B:
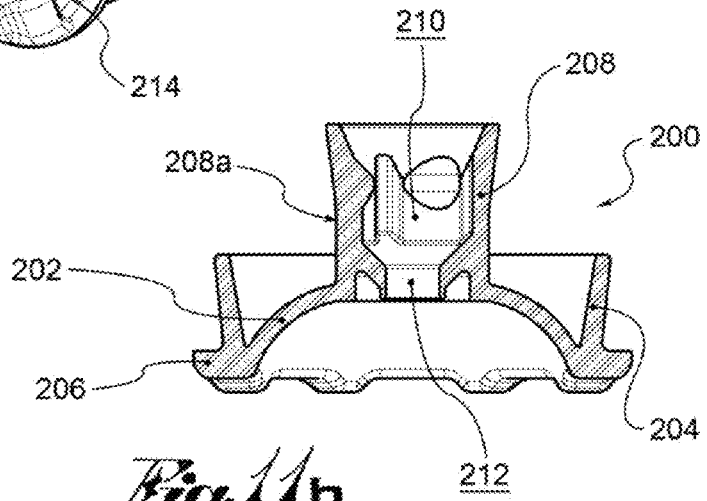
FIG. 11*b* shows a cross section of the main body of FIG. 11*a*.
Figure 11C:
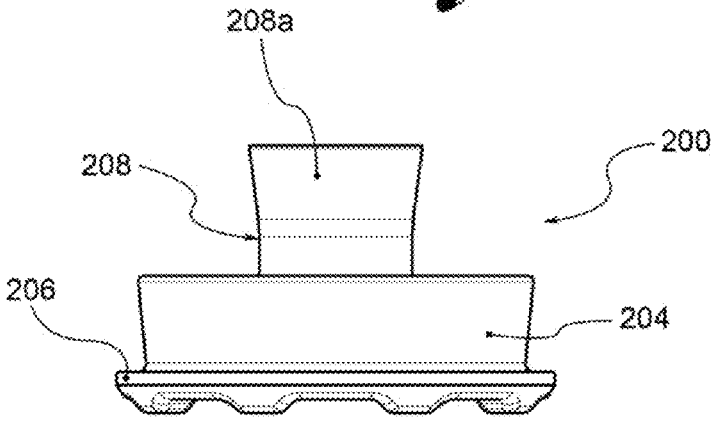
FIG. 11*c* shows a side view of the main body of FIG. 11*a*.

For example, head 20 may be coupled to container C by means of a threaded closure comprising a threaded ring nut 21 (FIGS. 1 to 7) or by means of a bayonet closure (FIG. 8 and following ones).

Head 20 further comprises a frame 22 which may be coupled to container C, preferably made as a single piece, for supporting the other components and making some passages for the liquid.

Frame 22 has a pressure chamber 24, annularly delimited by a chamber wall 25, having extension along a pressure axis Y, preferably incident with the container axis X, for example orthogonally.

Head 20 comprises a piston 26, sealingly slidable in the pressure chamber 24 along the pressure axis Y, between a rest position in which the volume of the pressure chamber 24 is maximum, and a limit dispensing position, in which the volume of the pressure chamber 24 is minimum, passing by intermediate dispensing positions.

Preferably, piston 26 comprises a head seal 26*a* and a tail seal 26*b*, spaced apart from the head seal along the pressure axis Y, for the seal between piston and the chamber wall 25 in which it slides.

Head 20 further comprises a manual actuation element adapted to manually move piston 26 in the pressure chamber 24.

Preferably, the actuation element comprises a trigger 28, adapted to operate on piston 26, for example anchored thereto, and engaged with frame 22, for example rotatably hinged thereto or sliding in translation thereon.

Preferably, moreover, head 20 comprises an elastic return element suitable for influencing piston 26 or trigger 28 for returning piston 26 towards the rest position.

Frame 22 further has a dispenser duct 30 having extension along a dispensing axis Z, between a distal end 32, at the outwards opening, and an opposite distal end 34.

Preferably, the pressure axis X is parallel to and separate from the dispensing axis Z.

Preferably, head 20 further comprises a nozzle 38, attached to the distal end 32 of the dispenser duct 30, for allowing the liquid to be dispensed according to the desired modes.

Frame 22 preferably comprises a mouth 90, formed by a mouth wall 92, having axial extension, which communicates with the pressure chamber 24 through a passage 93.

The mouth wall 92 is provided with an inner surface 92*a*, comprising a first portion or continuous cylindrical portion 92*a*', immediately upstream of passage 93, and a second portion or flared portion 92*a*", having a truncated-cone shape, converging towards passage 93, jointed to the cylindrical portion 92*a*'.

The flared portion 92*a*" consists of a plurality of projections 92*b* in a circumferential sequence, separated by recessed passages 92*b*' (FIG. 7).

Moreover, frame 22 comprises an annular connection wall 100 about the container axis X, radially externally spaced apart from the mouth wall 92.

Said connection wall 100 annularly delimits an intermediate compartment 102 suitable to be placed in communication with passage 93 through mouth 90 and in communication with an intermediate duct 104, which connects said intermediate compartment 102 with the dispenser duct 32, and in particular with the proximal end 34 thereof.

Preferably, the intermediate duct 104 extends along an intermediate axis K, parallel to the container axis X.

In particular, according to a preferred embodiment, the intermediate duct 104 laps the pressure chamber 24, from which it is separated by a bottom wall 24*a* which constitutes the bottom of the pressure chamber 24.

According to a further embodiment (FIG. 8 and following ones), frame 22 comprises a secondary connection wall 112, annular about the container axis X, radially externally spaced apart from the connection wall 100.

Moreover, frame 22 comprises a venting duct 110 suitable to place in communication compartment V inside container C with the external environment; said venting duct 110 opens towards the exterior on the sliding surface on which the sealing lips 26*a*, 26*b* of piston 26 slide.

Head 20 further comprises a valve dispenser element suitable for preventing the dispensing of liquid from the pressure chamber towards the dispenser duct up to reaching a predetermined threshold pressure in the pressure chamber.

Said valve dispenser element comprises a main body 200, made of a flexible material, such as EVA (ethyl-vinyl-acetate), PELD (low density polyethylene) or TPE (thermoplastic elastomer), attached to the connection wall 100 and to the mouth wall 92 of the frame so as to delimit the intermediate compartment 102.

The main body 200 comprises an annular membrane 202, attached to the connection wall 100.

According to an embodiment, in a rest configuration the membrane has a dome shape, convex towards the intermediate compartment 102 and concave at the opposite side.

The main body 200 further comprises an annular sealing lip 204, axially protruding from membrane 202 in the intermediate compartment 102, suitable for sealingly resting against the inner surface of the connection wall 100.

Preferably, the sealing lip 204 protrudes from membrane 202 to a predetermined distance from the peripheral edge, so as to determine a residual portion 206 of said membrane 202, which radially extends outside the sealing lip 204.

Preferably, the residual portion 206 abuts on the free end of the connection wall 100 of frame 22.

Moreover, the main body 200 comprises an annular engagement wall 208, having axial extension, protruding from membrane 202 towards the intermediate compartment 102.

The engagement wall 208 annularly delimits a feeding compartment 210, open on one side towards mouth 90 and passage 93 towards the pressure chamber 24 and on the other side through a gap 212 in membrane 202.

Moreover, preferably, the engagement wall 208 has an outer surface 208*a* having at least one end zone, distal from membrane 202, flared outwards.

According to a preferred embodiment (FIG. 8 and following ones), the main body 200 comprises a plurality of spacing elements 214, axially projecting from membrane 202, on a side opposite to the sealing lip 204, for constituting a firm support for the main body 200 on base 502 of the auxiliary body 500. Preferably, said spacing elements are arranged as a crown, peripherally to the main body 200, forming a sequence of ridges and depressions.

Moreover, head 20 comprises a check valve element suitable for preventing the return of liquid from the pressure chamber 24 towards the container.

According to a preferred embodiment (FIGS. 1, 2, 3*a*, 3*b*, 8 and following ones), the check valve element comprises a shutter 300, for example a ball, movable in the feeding duct 210 of the main body 200, and a shutter seat 302, for example having a truncated-cone shape, which defines gap 212.

Moreover, said check valve element comprises a retaining element suitable for retaining shutter 300 within the feeding duct 210.

For example, said retaining element comprises at least one protrusion 304, protruding within the feeding duct 210.

According to a further embodiment (FIGS. 5 and 6), shutter 300 of the check valve element consists of a flexible septum 400 set to close the feeding duct 210, hinged along a stretch of the edge thereof and separated by a cut.

In said embodiment, the engagement wall 208 cooperates with the mouth wall 92 through a protruding lip 402, sliding along the engagement wall 208.

Moreover, head 20 comprises a connection element suitable for mechanically connecting the main body 200 of the valve dispenser element with frame 22.

Preferably, said connection element comprises an auxiliary body 500, made of a stiff material compared to the material which constitutes the main body of the valve dispenser element. For example, said auxiliary body is made of PP (polypropylene).

Preferably, the auxiliary body 500 comprises a base 502, for example having a disc shape, and an annular coupling wall 504, which axially extends from base 502, for example in peripheral portion.

Moreover, the auxiliary body 500 comprises a tang 506, protruding from base 502 towards container C, which defines a suction duct 507 in communication with compartment V of container C, provided with a tang gap 508 passing through base 502.

Tang 506 is suitable for the insertion of a flexible suction pipe.

The coupling wall 504 of the auxiliary body 500 is coupled, for example snap-wise, with the connection wall 100 of the frame, so that membrane 202 of the valve dispenser element and in particular the residual portion 206 thereof, is kept abutting on the free end of said connection wall 100.

In the embodiment variant which contemplates the secondary connection wall 112 (FIG. 8 and following ones), the radial distance between said secondary connection wall 112 and the connection wall 100 is such as to allow the insertion and seating without radial interference of the coupling wall 504 of the auxiliary body 500.

Moreover, according to such embodiment variant, the element connecting the main body 200 of the valve dispenser element to frame 22 are is integrated with a sealing element between the dispenser head 20 and neck N of container C.

For example, the auxiliary body 500 comprises a secondary annular sealing lip 510 arranged radially externally to the coupling wall 504. Preferably, said secondary sealing lip 510 has a recessed bevel 512 at the free end to facilitate the insertion of neck N of container C in the access opening A.

In fact, once head 20 has been applied to container C, said secondary sealing lip 510 arranges itself in contact with the inner surface of neck N for implementing the seal between head 20 and said container C.

Preferably, said secondary sealing lip 510 consists of the end portion of a turned lip 514 which extends from base 502 of the auxiliary body 500. Said turned lip 514 comprises a secondary coupling wall 516 which connects base 502 to the secondary sealing lip 510, suitable for mechanically connecting, preferably snap-wise, with the secondary connection wall 112 of frame 22.

Advantageously, the turned lip configuration increases the component elasticity, facilitating the insertion in the bottleneck, and improves the seal.

In an initial rest configuration (FIG. 2*a*), piston 26 is in the rest position and shutter 300 closes gap 212 of the feeding duct 210, so that the pressure chamber 24 is separate from compartment V of container C and in particular from the suction duct 507 defined by tang 506.

Moreover, membrane 202 is separate from the mouth wall 92, while the engagement wall 208 is sealingly engaged with said mouth wall 92, and in particular with the cylindrical portion 92*a*' of the inner surface 92*a* thereof, so that the pressure chamber 24 is separate from the intermediate compartment 102 and thus from the dispenser duct 32.

Admitting that an amount of liquid is already present in the pressure chamber 24, by actuating the trigger, an active step is started in which piston 26 works in pressure in the pressure chamber 24, trying to push the liquid out of the pressure chamber 24, towards mouth 90.

The liquid works on shutter 300 for closing the feeding duct 210 more powerfully; therefore, the liquid does not return into compartment V of the container through the suction duct 507.

The liquid works on shutter 300 and on the surfaces of the feeding duct 210 developing an action which, deforming membrane 202, makes the engagement wall 208 slide with respect to the mouth wall 92.

The displacement of the engagement wall 208 is linked to the deformation of membrane 202; such deformation takes place in a particularly effective and repetitive manner since the membrane, in the rest configuration, is not engaged with the mouth wall 92.

Figure 1:
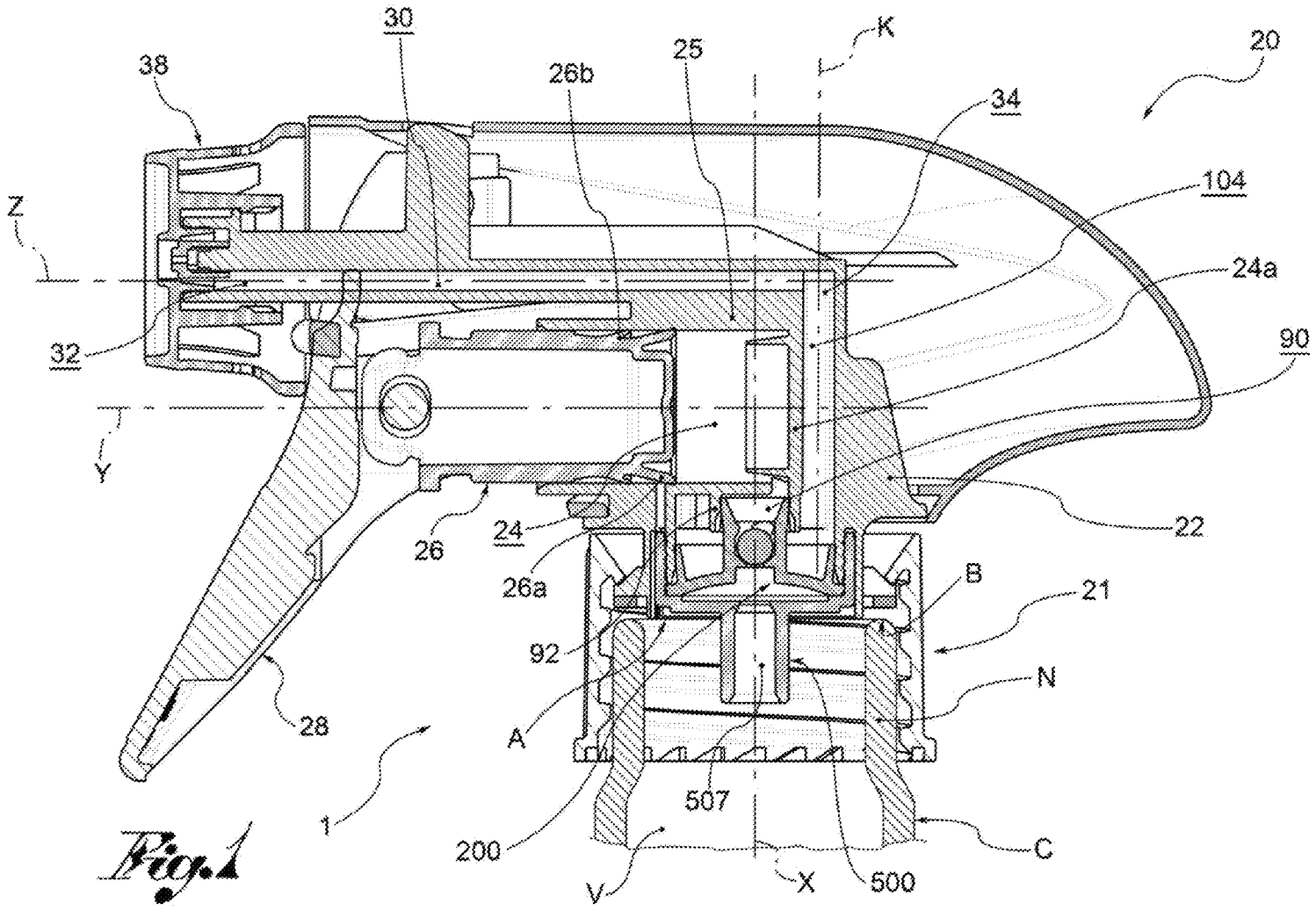
FIG. 1 shows a cross section of a dispenser head of a dispenser according to an embodiment of the present invention.
Figure 2A:
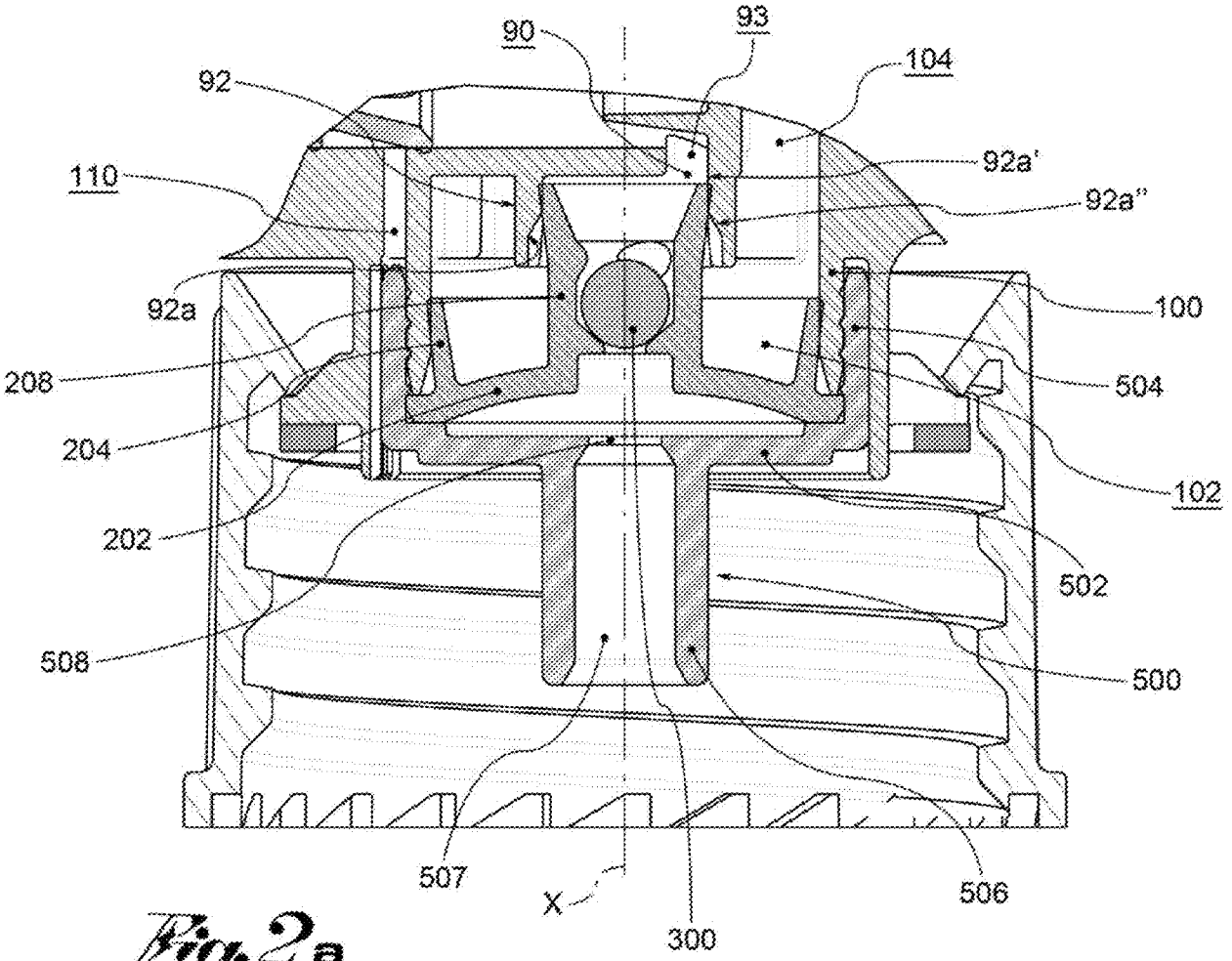
FIG. 2*a* shows an enlargement of a detail of FIG. 1, wherein a valve dispenser element in a rest configuration is highlighted.
Figure 2B:
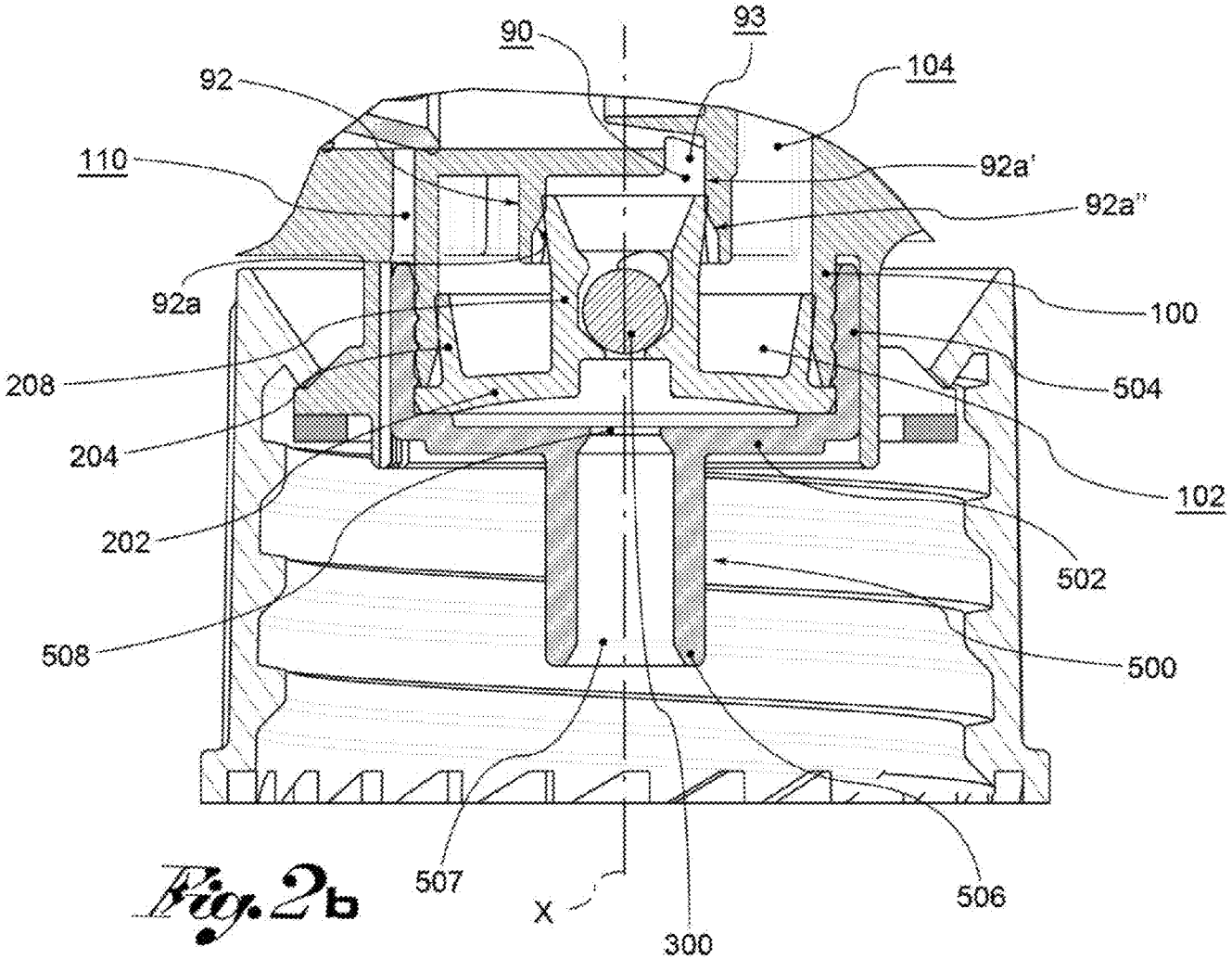
FIG. 2*b* shows the valve dispenser element in a pre-dispensing configuration of an active step.

Therefore, in a first sub-step or pre-dispensing sub-step of the active step, the liquid pressure in the pressure chamber increases, but no liquid is yet dispensed to the outside since the engagement wall 208 is still sealingly in contact with the mouth wall 92, so that the pressure chamber 24 is separate from the dispenser duct (FIG. 2*b*).

The sliding of the engagement wall 208, due to the further deformation of membrane 202, continues until, at the flared portion 92*a*", passages 92*b*" of the flared portion 92*a*" open up, suddenly placing the pressure chamber 24 in communication with the intermediate compartment 102 and thus with the dispenser duct 32.

Figure 2C:
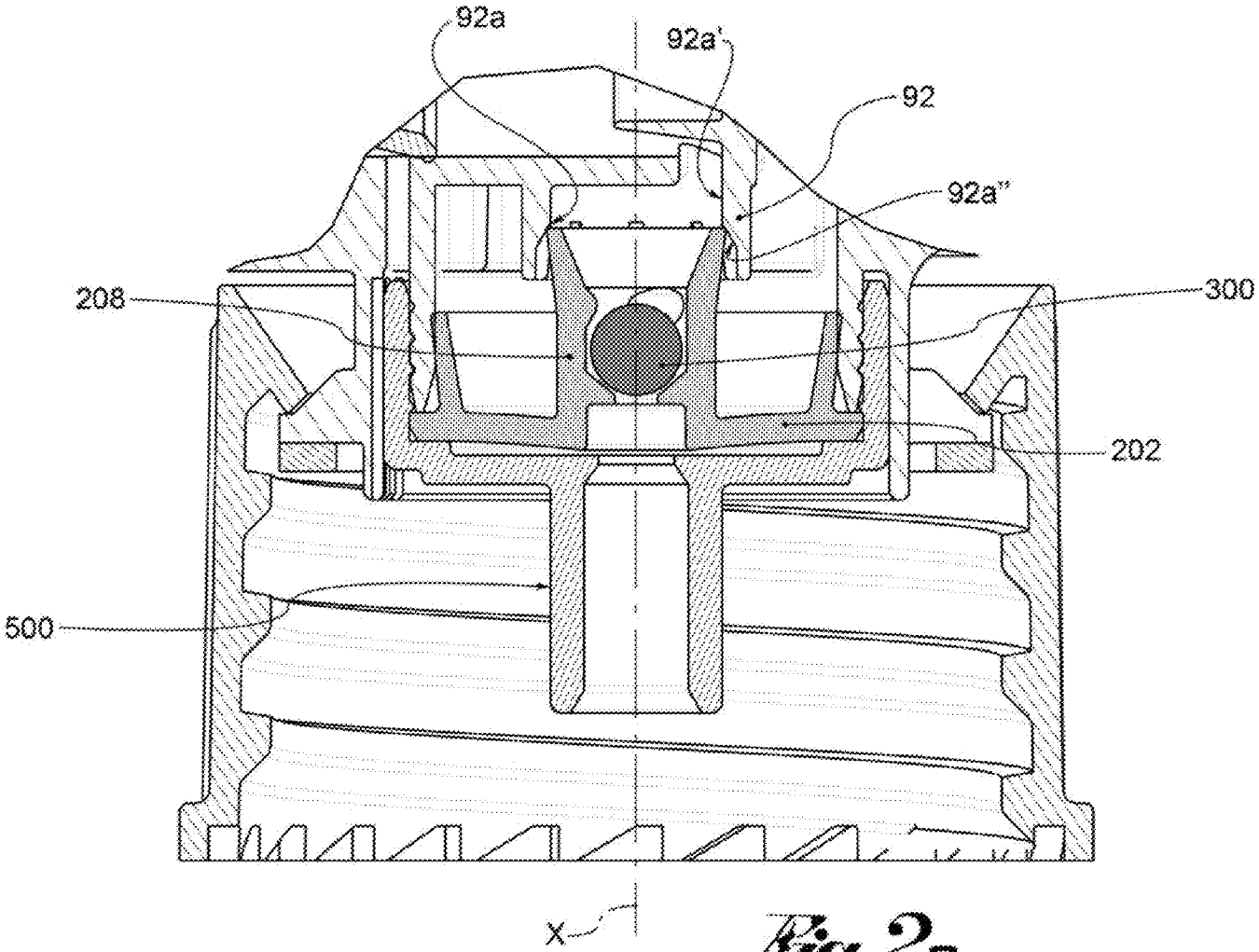
FIG. 2*c* shows the valve dispenser element in a dispensing configuration of the active step.
Figures 3A, 3B:
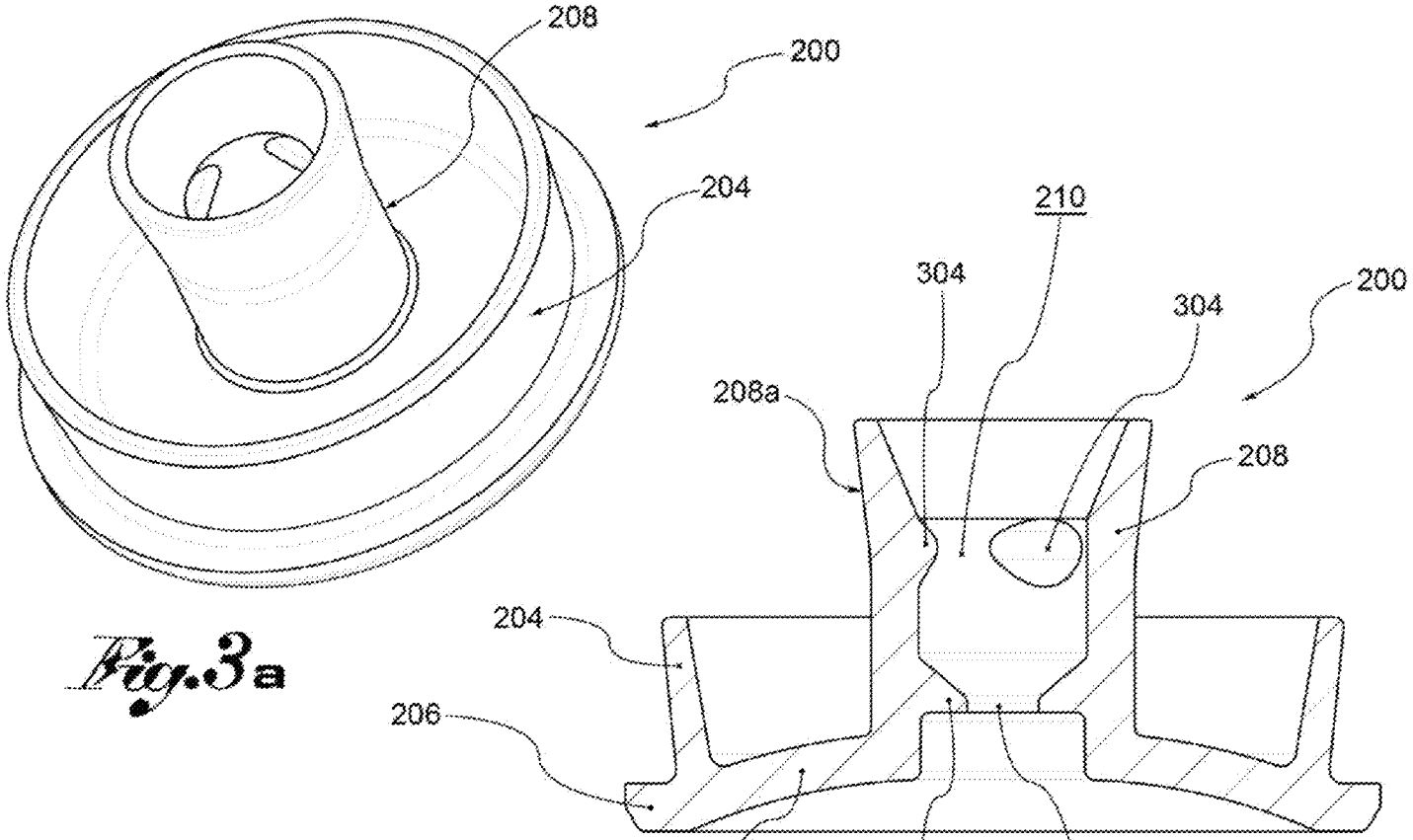
FIG. 3*a* shows a main body of the dispenser element of the head of FIG. 1.
FIG. 3*b* shows a cross section of the main body of FIG. 3*a;*
Figure 4B:
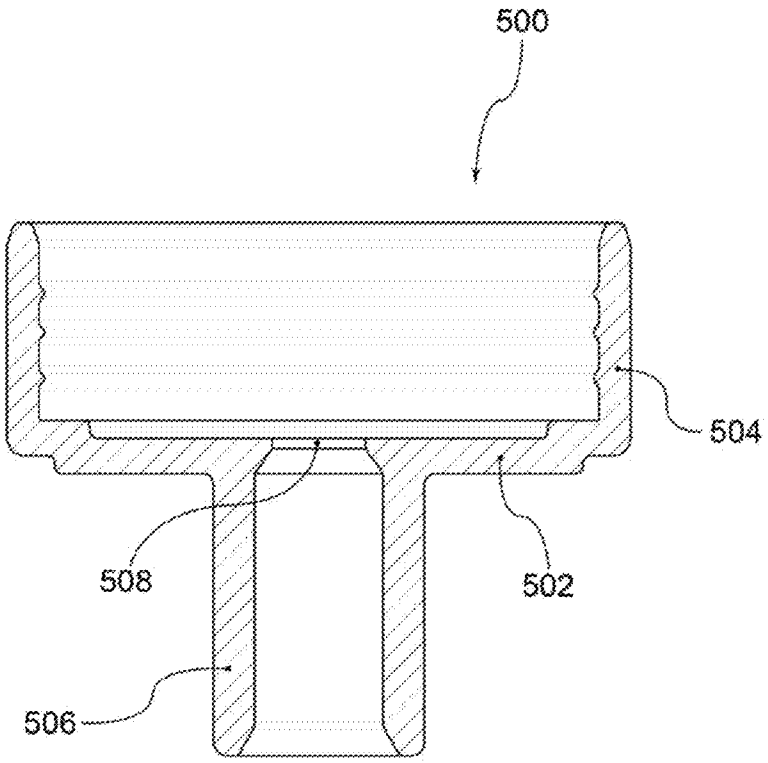
FIG. 4*b* shows a cross section of the auxiliary body of FIG. 4*a;*
Figure 4A:
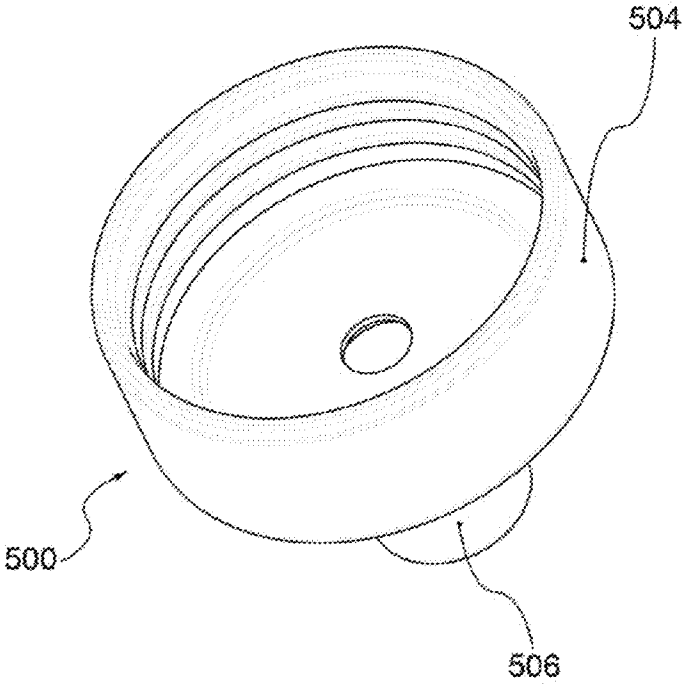
FIG. 4*a* shows an auxiliary body of a connection element of the head of FIG. 1.
Figure 5:
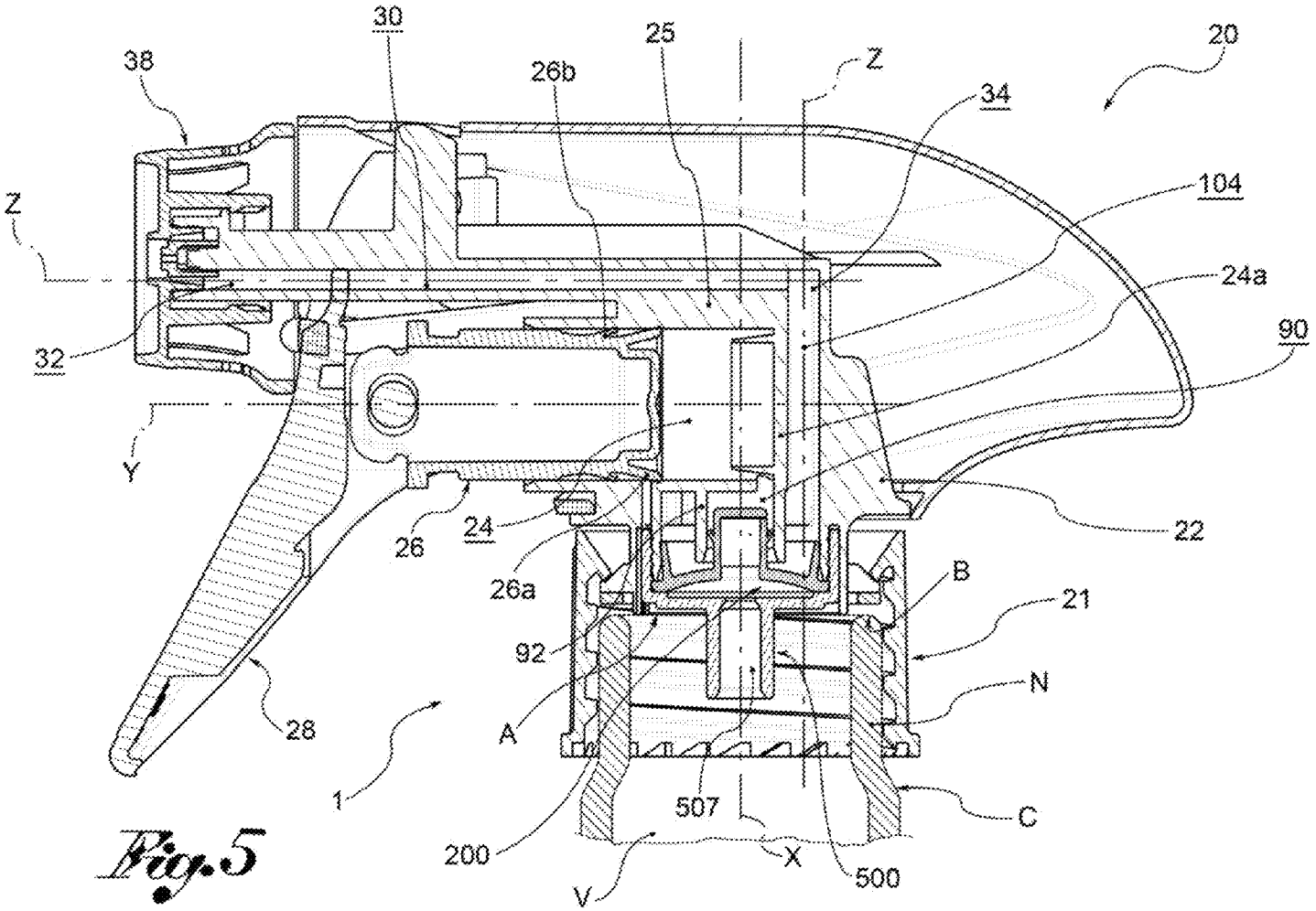
FIG. 5 shows a cross section of a dispenser head of a dispenser according to a further embodiment of the present invention.
Figure 6:
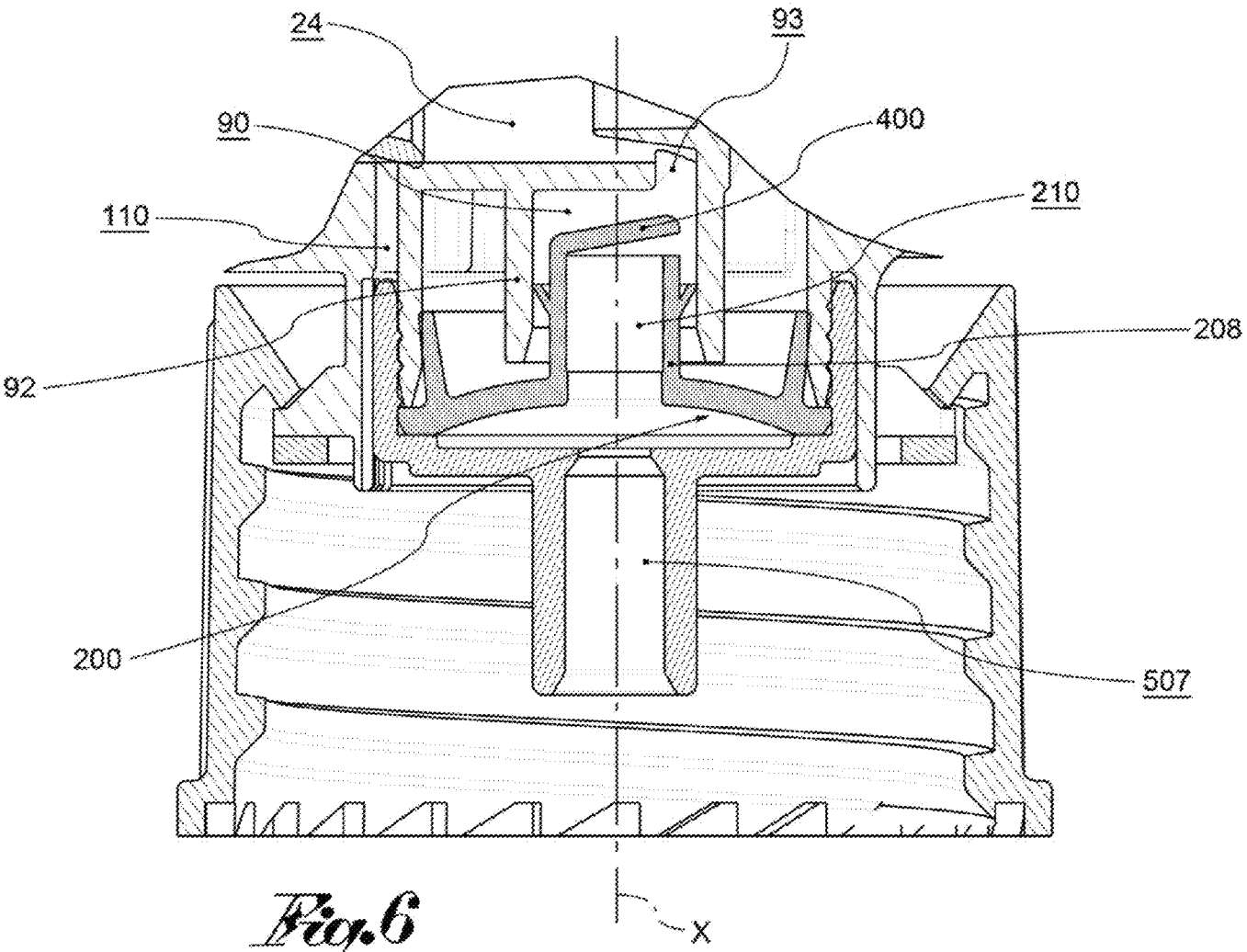
FIG. 6 shows an enlargement of a detail of FIG. 5.

Therefore, in a second sub-step or dispensing sub-step of the active step, the liquid is dispensed to the outside since passages 92*b*" open up between the engagement wall 208 and the mouth wall 92, so that the pressure chamber 24 is in communication with the dispenser duct (FIG. 2*c*).

The deformation of membrane 202 is limited by the auxiliary body 500, and in particular by base 502 which forms a stiff abutment for said membrane 202.

When the trigger is released, the elastic return element moves piston 26 or trigger 28 from the limit dispensing position towards the rest position.

The vacuum resulting in the pressure chamber 24 and the elastic return of membrane 202, return the engagement wall 208 in sealed engagement with the mouth wall 92, and in particular with the cylindrical portion 92*a*' of the inner surface 92*a*.

Moreover, the vacuum resulting in the pressure chamber 24 works on shutter 300 so as to open the feeding duct 210 towards the pressure chamber 24. The liquid contained in compartment V of container C is thus drawn through tang 506, the feeding duct 210 and mouth 90, reaching the pressure chamber 24.

At least by a stretch of the return step, the venting duct 110 is in communication with the external environment, so that the air may be drawn in compartment V of container C, before being closed again by the sealing lips 26*a*, 26*b* of piston 26.

Innovatively, the dispenser according to the present invention allows a high behaviour repeatability of the dispenser to be obtained in dispensing, since the opening of the valve dispenser element is precise and repetitive, while keeping a simple structure thanks to the integration of the valve functions in few components.

In particular, advantageously, the device has a high operating repeatability especially in dispensing, mainly because the membrane, in the rest configuration, is not subject to any deformation since it is separate from the mouth wall.

Advantageously, moreover, the aesthetics of the device, defined for example by the shape of the cover or frame, may take several configurations.

This is mainly due to the position of the functional component of the device and in particular to the membrane position, which prevents structural interferences with the elements defining the aesthetics of the device, without detriment to the correct and functional sizing of the same.

Advantageously, moreover, the device operation is highly reliable since even strong pressures cause a controlled deformation of the membrane, limited by the auxiliary body.

According to a further advantageous aspect, the suction pipe connection is particularly easy and has no consequences on the functionality of the other parts of the valve dispenser element since the suction pipe is connected to the stiff auxiliary body.

It should be noted that a person of skill in the relevant art can make certain modifications to the invention by reference to the present description and Figures. Such modifications are intended to fit within the scope of protection as claimed herein.

The invention claimed is:

1. A trigger dispenser for a liquid comprising:

a container having an inner compartment for the containment of the liquid;

a dispenser head attachable to the container, comprising:

a) a pressure chamber and a piston operable by the trigger and slidable in the pressure chamber, in a dispensing step in which it operates with pressure in the pressure chamber and in a return step in which it operates with suction in the pressure chamber;

b) a mouth delimited by a mouth wall, in fluid communication with the pressure chamber, for the passage of the liquid entering the pressure chamber during the return step and exiting the pressure chamber during the active step;

c) a dispenser duct suitable for being placed in communication with the pressure chamber via the mouth, for dispensing the liquid outwards;

d) a valve dispenser element comprising an engagement wall, the engagement wall:

i) in a pre-dispensing sub-step of the active step being engaged so as to sealingly slide with a first portion of the mouth wall to prevent the communication of the pressure chamber with the dispenser duct, and ii) in a dispensing sub-step of the active step, being engaged with a second portion of the mouth wall, provided with passages to allow the communication of the pressure chamber with the dispenser duct.

2. The device of claim 1, wherein the valve dispenser element comprises a main body comprising a flexible membrane and the engagement wall, axially projecting from the membrane.

3. The device of claim 2, wherein, in a rest configuration of the device, the membrane is separate from the mouth wall.

4. The device of claim 1, comprising a check valve element for preventing the return of liquid from the pressure chamber towards the compartment of the container, cooperating with the engagement wall.

5. The device of claim 4, wherein the engagement wall is tubular and delimits a communication duct, and the check valve element can be activated on the communication duct.

6. The device of claim 1, wherein the first portion of the inner surface of the mouth wall is cylindrical and the second portion is flared.

7. The device of claim 1, wherein the dispenser head comprises a frame in which the pressure chamber is made and to which the valve dispenser element is attached.

8. The device of claim 7, wherein the dispenser head comprises a connection element separate from the valve dispenser element and suitable for mechanically connecting the valve dispenser element to the frame.

9. The device of claim 8, wherein the connection element comprises an auxiliary body which can be snap-coupled to the frame.

10. The device of claim 9, wherein the auxiliary body comprises a tang projecting towards the compartment of the container suitable for the application of a suction pipe.

11. The device of claim 1, wherein the dispenser head comprises an annular connection wall, radially externally spaced apart from the mouth wall, which annularly delimits an intermediate compartment for housing the valve dispenser element.

12. The device of claim 11, wherein the intermediate compartment is in communication with an intermediate duct, which connects the intermediate compartment with the dispenser duct, and laps the pressure chamber, from which it is separated by a bottom wall which comprises the bottom position of the pressure chamber.

13. The device of claim 8, wherein the connection element integrally comprise a sealing element to provide the seal between the dispenser head and the container.

14. The device of claim 7, wherein the dispenser head comprises a connection element separate from the valve dispenser element and suitable for mechanically connecting the valve dispenser element to the frame, wherein the connection element comprises an auxiliary body which can be snap-coupled to the frame, wherein the connection element integrally comprises a sealing element to provide the seal between the dispenser head and the container, and wherein the auxiliary body comprises a coupling wall for the snap-wise engagement with the frame and a secondary annular sealing lip, radially externally spaced from the coupling wall, for implementing the seal.

15. A dispenser head attachable to a container having an inner compartment for the containment of a liquid, comprising:

a) a pressure chamber and a piston operable by a trigger and slidable in the pressure chamber in an active step in which it operates with pressure in the pressure chamber and in a return step in which it operates with suction in the pressure chamber;

b) a mouth delimited by a mouth wall, in fluid communication with the pressure chamber through a passage, suitable for the passage of the liquid entering the pressure chamber during the return step and exiting the pressure chamber during the active step;

c) a dispenser duct, suitable for being placed in communication with the pressure chamber via the mouth, for dispensing the liquid outwards;

d) a valve dispenser element for controlling the exit of the liquid from the pressure chamber during the active step;

e) a frame in which the pressure chamber is made and to which the valve dispenser element is attached;

f) a connection element separate from the valve dispenser element and suitable for mechanically connecting the valve dispenser element to the frame;

wherein the frame comprises an annular connection wall which annularly delimits an intermediate compartment suitable to be placed in communication with passage through mouth and in communication with an intermediate duct, which connects the intermediate compartment with the dispenser duct;

and wherein the valve dispenser element comprise a main body attached to the connection wall and to the mouth wall of the frame so as to delimit the intermediate compartment.

16. The device of claim 15, wherein the connection element integrally comprises a sealing element to provide a seal between the dispenser head and the container.

* * * * *